US005915498A

United States Patent [19]

Figliuzzi

[11] Patent Number: 5,915,498

[45] Date of Patent: Jun. 29, 1999

[54] LADDER WITH NESTING LATERAL SUPPORT BRACES

[76] Inventor: Joseph Figliuzzi, HC 70 County Rd. 23, Kelliher, Minn. 56650

[21] Appl. No.: 09/129,643

[22] Filed: Aug. 5, 1998

Related U.S. Application Data

[63] Continuation-in-part of application No. 08/322,612, Oct. 13, 1994, Pat. No. 5,791,437.

[51] Int. Cl.[6] ..... E06C 5/36

[52] U.S. Cl. ..... 182/172; 182/165

[58] Field of Search ..... 182/172, 165, 182/173, 107; 16/388

[56] References Cited

U.S. PATENT DOCUMENTS

| | | | |
|---|---|---|---|
| 346,437 | 7/1886 | Geissinger . | |
| 485,900 | 11/1892 | Tannenberg . | |
| 943,236 | 12/1909 | Campbell . | |
| 1,135,336 | 4/1915 | Vanhouten . | |
| 1,135,763 | 4/1915 | Caronia . | |
| 1,235,696 | 8/1917 | Keith . | |
| 1,415,791 | 5/1922 | Caronia . | |
| 1,526,654 | 2/1925 | Yordy . | |
| 1,610,596 | 12/1926 | Bird . | |
| 1,924,213 | 8/1933 | Newman . | |
| 2,008,582 | 7/1935 | Fredricksen . | |
| 2,364,048 | 12/1944 | Barkey . | |
| 2,577,456 | 12/1951 | Doman | 16/388 |
| 2,750,243 | 6/1956 | Zielfeldt . | |
| 2,997,127 | 8/1961 | Wajtowicz . | |
| 3,396,928 | 8/1968 | Lay . | |
| 3,568,798 | 3/1971 | Pierce . | |
| 3,856,111 | 12/1974 | Stewart . | |
| 3,878,917 | 4/1975 | McBride . | |
| 4,565,262 | 1/1986 | Hawkins | 182/172 |
| 4,681,187 | 7/1987 | Brown . | |
| 4,798,262 | 1/1989 | Margolies | 182/172 |
| 4,872,529 | 10/1989 | Viets . | |
| 4,964,488 | 10/1990 | Stewart . | |
| 5,069,144 | 12/1991 | Williford . | |

*Primary Examiner*—Alvin Chin-Shue
*Attorney, Agent, or Firm*—Richard C. Litman

[57] ABSTRACT

A ladder with nesting lateral support braces includes a pair of nesting braces which internally receive the pair of side support rails of a ladder during storage of the ladder. Each of the nesting braces is attached to a side rail by a hinge for rotation into and out of a support position. A support arm is provided to prevent over-rotation of the nesting braces. Each of the nesting braces may additionally include an expansible leg for use of the ladder on uneven support surfaces.

14 Claims, 6 Drawing Sheets

LADDER WITH NESTING LATERAL SUPPORT BRACES

CROSS REFERENCE TO RELATED APPLICATION

This application is a continuation in part of application Ser. No. 08/322,612, filed on Oct. 13, 1994, U.S. Pat. No. 5,791,437, issued Aug. 11, 1998.

BACKGROUND OF THE INVENTION

1. Field of the Invention

The present invention relates to ladders. More specifically, the present invention relates to ladder devices with support braces to help prevent accidental lateral movement of a ladder.

2. Description of the Related Art

In the past, a number of devices have been attached to the side support rails of a ladder to reduce the risk of lateral tripping during periods of use. These devices were generally of insufficient structural support resulting in failure, especially during use in increased load situations. The devices used to provide bilateral support were additionally expandable in order to provide for engagement of the supports to a ground surface following the placement of a ladder in a desired location. The means employed for retention of the expandable features in an extended position also frequently failed as a result of inadequate structural design. Additionally, the devices used for bilateral support frequently increased the bulkiness, clumsiness, and storage space required for a ladder during periods of portability or non-use. In many cases these bulky and unbalanced devices made it difficult to use the ladder in a conventional manner and could only be used with the stabilizer supports fully engaged. In addition, these devices did not consider the importance of maintaining the natural design profile of the ladder. As a result, the stabilizer supports became "protruding appendages" that deviated considerably from standard ladder design which made them inconvenient or unsafe to operate.

The bilateral support devices as known fail to incorporate a hinge of increased structural strength and durability into a nesting brace for the provision of improved support for a ladder. The bilateral support devices as known have not provided a mechanism for automatically locking a hinge and a corresponding nesting brace into an operative position. These support devices also have not included a coupling feature for mating of the pair of side support rails into the nesting braces for convenient transportation and storage of a ladder. These support devices have not incorporated their side support rails into a profile of a standard ladder design making the side supports almost indistinguishable from the ladder itself in the closed or non-use position. Past support devices have not allowed for use of the ladder in a conventional manner without support braces. These devices have not added the benefit of a nesting ability, doubling the strength and support of existing ladder side rails when the ladder is used conventionally without the side support extended. Finally, the support devices as known have not included an expansible feature of sufficient strength and durability to support the use of a ladder upon a non-level support surface during increased load situations.

None of the above inventions and patents, taken either singularly or in combination, is seen to describe the instant invention as claimed. Thus a ladder with lateral support braces solving the aforementioned problems is desired.

SUMMARY OF THE INVENTION

The ladder device of the present invention comprises upright, nesting braces for lateral support of a common ladder of any type. The nesting braces are hingedly attached to side rails of the ladder frame by hinges. The hinges may be strengthened by a hinge stiffening plate, while overrotation of the nesting braces is prevented by using locking support arms in combination with a stop plate. Each nesting brace is designed to fit over each side rail of the ladder for storage or use without lateral support as a standard ladder. The nesting braces may also provide an expansible leg for use on all support surfaces including even and uneven surfaces. The nesting braces add lateral stability and help prevent tipping of the ladder.

Accordingly, it is a principal object of the invention to minimize the risk of injuries to individuals by providing improved bilateral support through the use of nesting support braces.

It is another object of the invention to retain standard ladder profile and design during periods of non-use and portability.

It is a further object of the invention to provide an adjustable ladder for use on non-level support surfaces.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
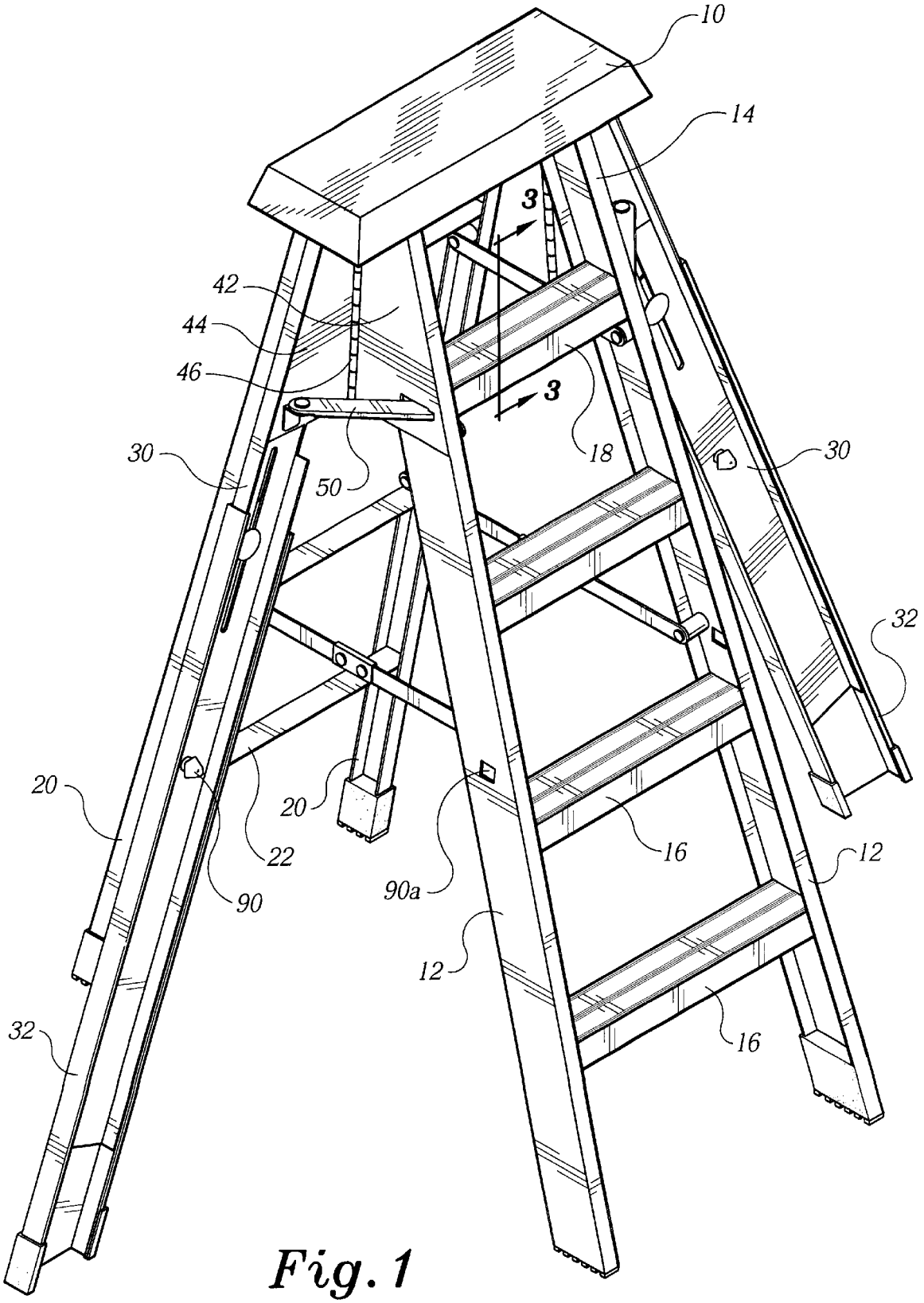
FIG. 1 is a perspective view of a ladder with nesting lateral support braces according to the present invention.
Figure 2:
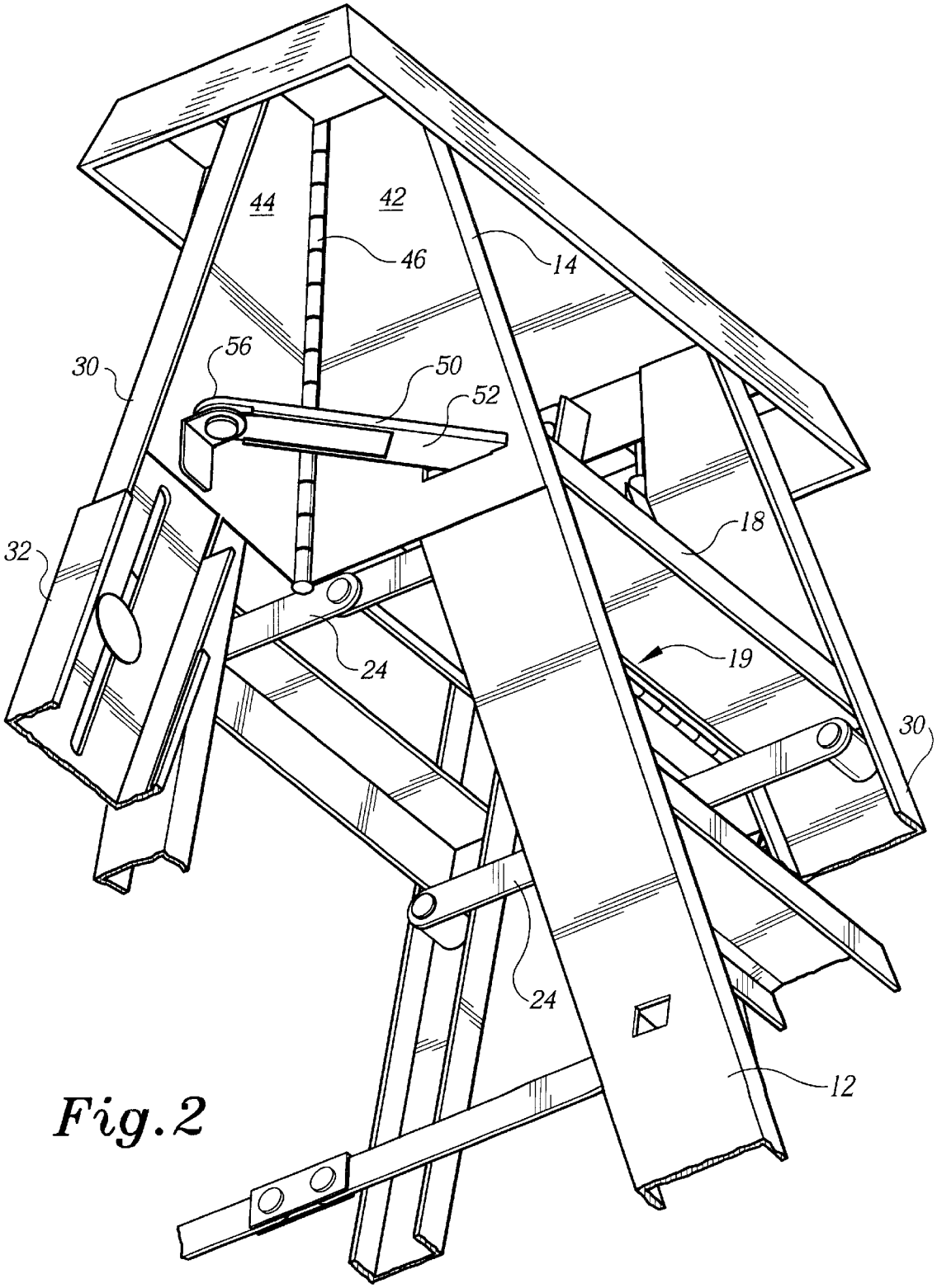
FIG. 2 is a is a partial perspective view of the hinge of a ladder with nesting lateral support braces according to the present invention.
Figure 3:
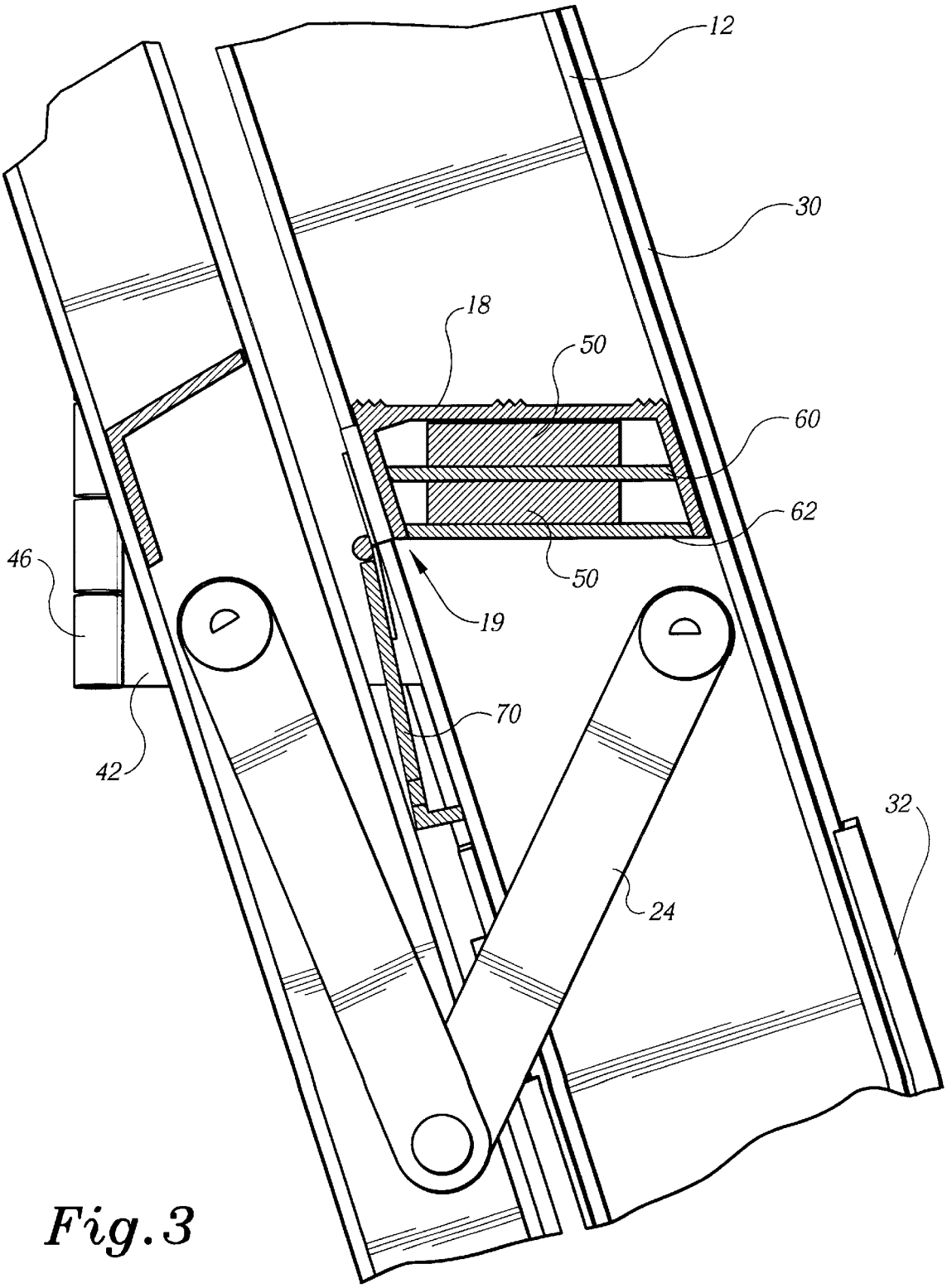
FIG. 3 is a cross sectional view of the upper portion of a ladder with nesting lateral support braces as shown along line 3—3 of FIG. 1.
Figure 4:
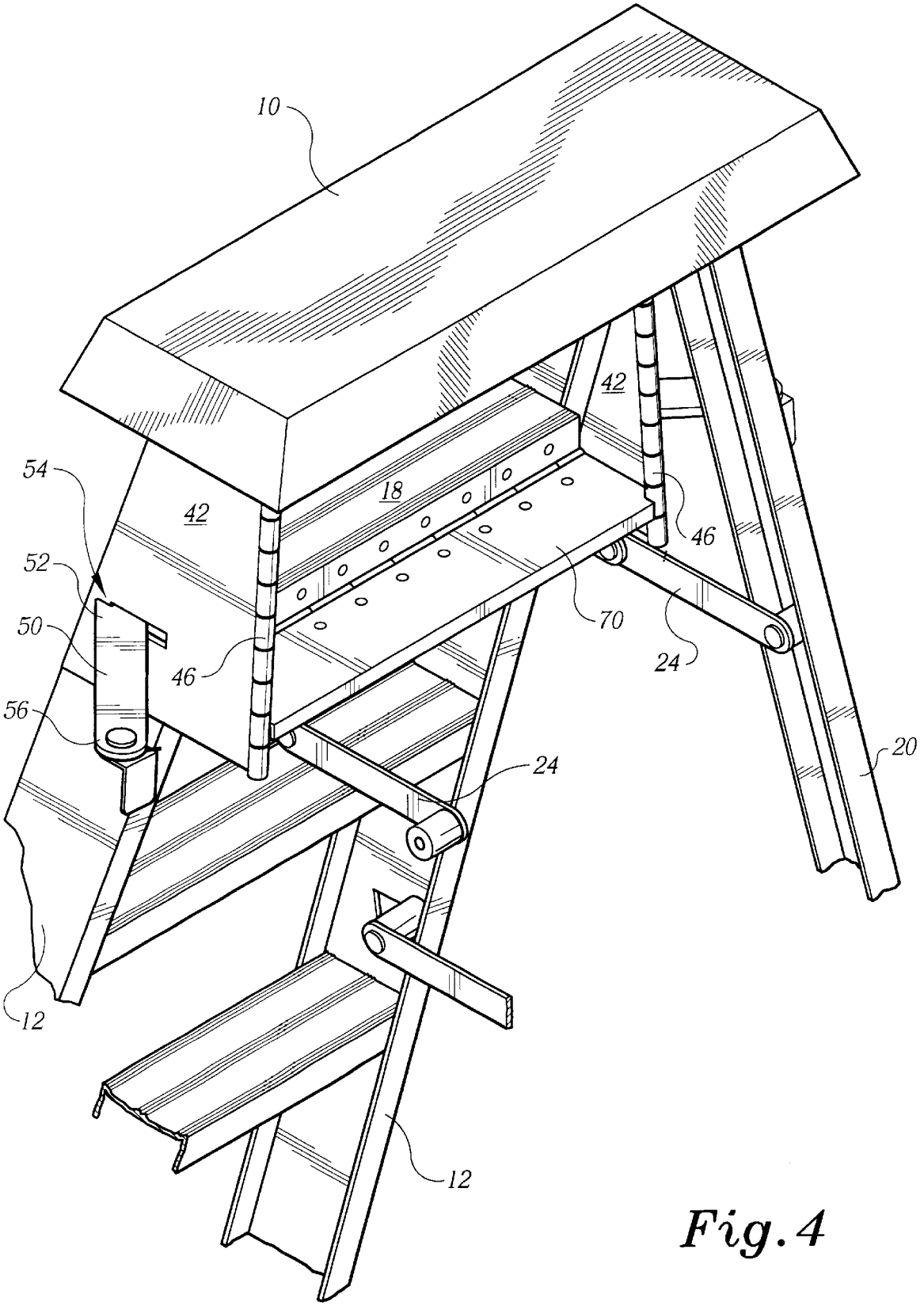
FIG. 4 is a rear perspective cut-away view of the hinge stiffening plate of a ladder with nesting lateral support braces according to the present invention.
Figure 5:
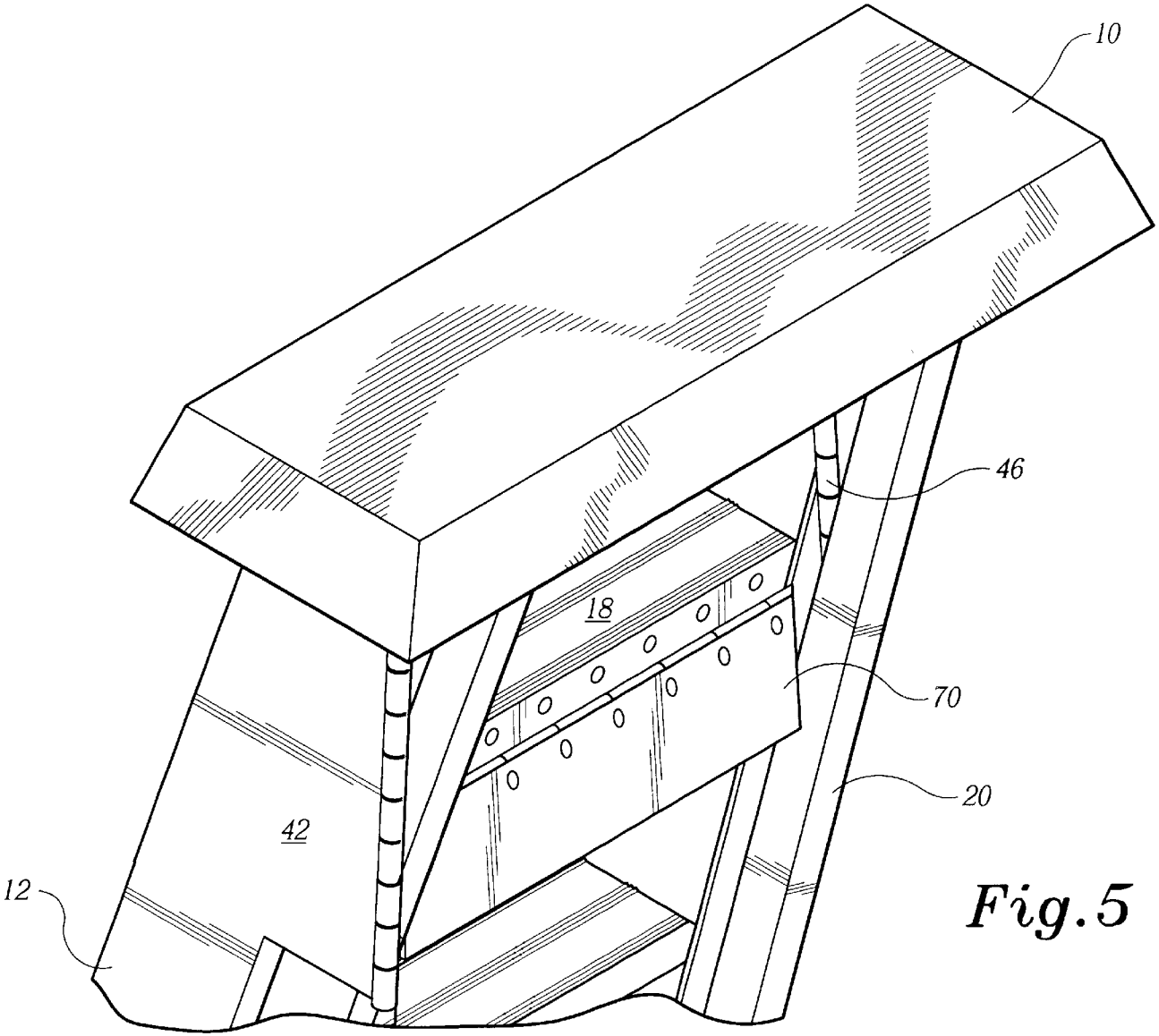
FIG. 5 is a perspective view of the hinge stiffening plate (in a closed position) on a ladder with nesting lateral support braces according to the present invention.
Figure 6:
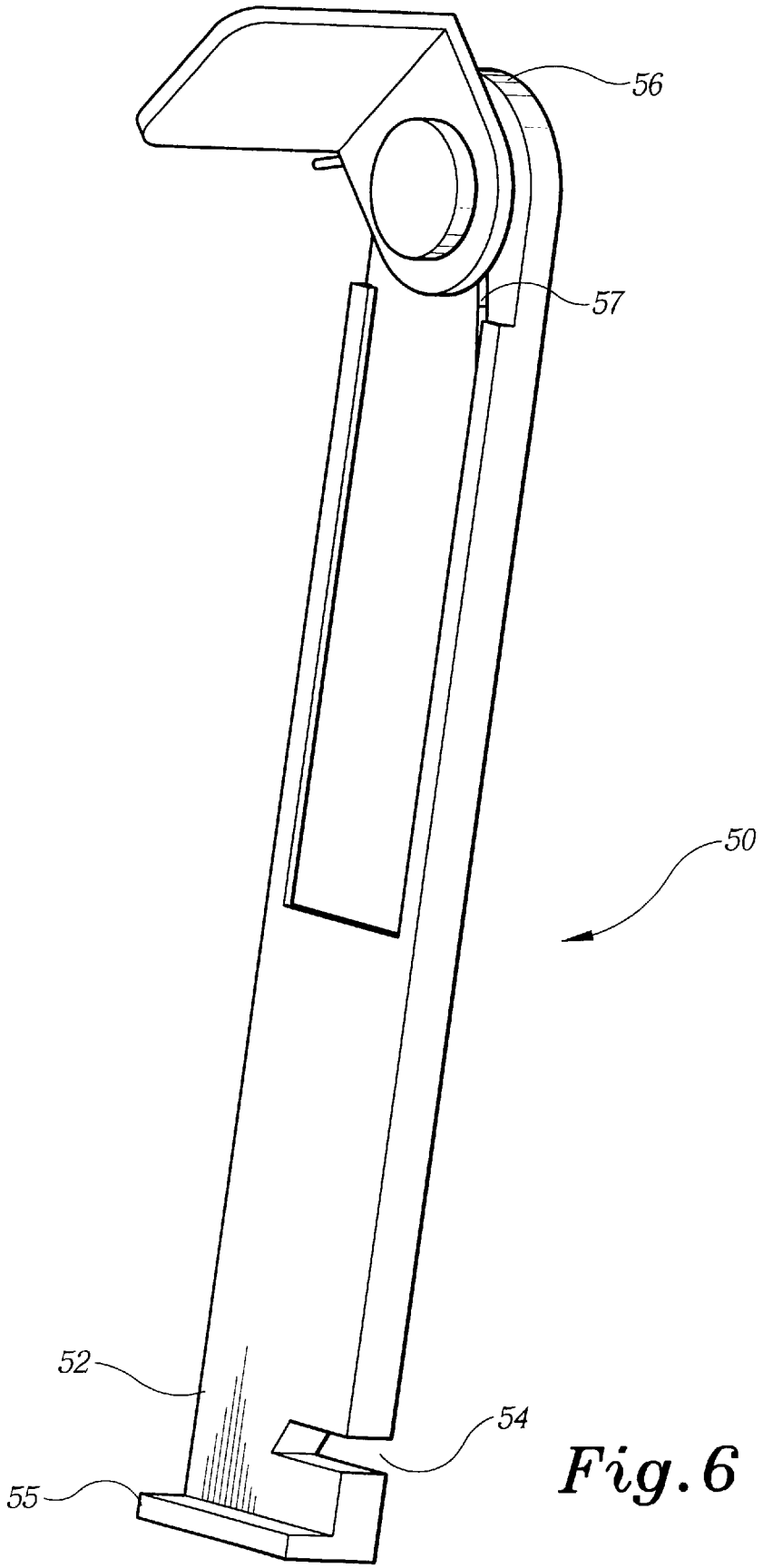
FIG. 6 is a detail view of the support arm on a ladder with nesting lateral support braces according to the present invention.

The present invention is adapted to be attached to or become integral with a common ladder. The ladder type used may be either a common step ladder (A-frame) as illustrated in the Figures and described herein, or of the extensible, telescoping type. It is important to note that for safety reasons, common step ladders are wider at the base. The ladder may be constructed of aluminum, fiberglass, composite, wood, or any commonly accepted construction materials or a combination thereof. As shown, a preferred embodiment of the present invention employs a step ladder (A-frame) including a top shelf 10, a pair of elongated side rails 12, a plurality of rungs 16, a pair of brace legs 20 with brace tie 22, a pair of elbow brackets 24, a pair of upright nesting braces 30, and a pair of hinges connecting the nesting braces 30 to the side rails 12.

As seen in FIG. 1, the pair of side rails 12 are attached at an upper end 14 to the underside of the top shelf 10. A plurality of rungs 16 extend between and connect the two side rails 12, and are designed to support the weight of a person and a carried load. A top rung 18 is located a predetermined distance from the upper end 14 of the side rails 12 and the top shelf 10. A pair of brace legs 20 are pivotally attached either to the underside of the top shelf 10, or to the side rails 12 themselves. At least one brace tie 22 extends between the two brace legs 20, and preferably at least two brace ties 22 will be used. To limit the distance the brace legs 20 can pivot and to add support, a pair of locking elbow brackets 24 connect each side rail 12 to a corresponding brace leg 20.

Upright nesting braces 30 are added to the basic ladder structure to selectively increase lateral support. A pair of nesting braces 30 are provided, each hingedly attached to one of the side rails 12. Each nesting brace 30 has a length equal to the length of the side rail 12, and is adapted to fit over the side rail 12 for storage and portability. When in a stored position, the ladder is nearly indistinguishable from the standard A-frame ladder.

Each nesting brace 30 is attached to a side rail 12 by a hinge. A first hingeplate 42 is attached to the upper end 14 of each side rail 12. A second hingeplate 44 is attached to each nesting brace 30. In the most preferred embodiment, the hingeplates will be integrally formed with the side rails 12 and nesting braces 30. The first and second hingeplates extend downward a predetermined distance to the level of the top rung 18 of the ladder. A substantially vertical hinge joint 46 connects the two plates for each nesting brace 30 and side rail 12 combination. The hinge allows rotation of the nesting brace 30 from a closed position to a position for lateral support. In the closed position, each nesting brace 30 surrounds and accepts a side rail 12 creating a normal ladder profile. This is useful in transporting and storing the ladder as well as when lateral support is not needed. In a support position, each nesting brace 30 is rotated ninety degrees so that the nesting braces 30 offer lateral support to prevent tipping or rocking of the ladder.

To prevent over rotation of the nesting braces 30, which would decrease the amount of lateral support given, a pair of locking support arms 50 and a stop plate are provided to limit the range of motion of the nesting braces 30. Each support arm 50 has a first end 52 which slides through an opening defined by the first hinge plate. This first end 52 is provided with a slot 54 designed to engage the first hingeplate 42 when the nesting brace 30 is in a support position. A support arm lip 55 is also provided to prevent the support arm from slipping through the hingeplate. The hingeplate is held by the slot 54 until it is disengaged by hand. A spring 57 biases the support arm to a position where the slot 54 engages the hingeplate. Hand pressure releases the spring tension, and allows the support arm to be returned to a closed position. A second end 56 of each support arm 50 is pivotally attached to the second hingeplate 44 found on each nesting brace 30.

The support arms 50 preferably slide through the first hingeplate 42 and are hidden within the top rung 18. Inside the top rung 18, one support arm 50 passes over the other, preferably separated by an upper separator plate 60 to prevent the two arms 50 from catching on one another. A lower separator plate 62 is also provided to prevent fingers and the like from getting caught in the movement of the support arm 50 in the top rung 18.

To add stability and strength to the hinge and hingeplates, a stiffening plate 70 is provided. The stiffener plate 70 is attached to a rear edge 19 of the top rung 18, and extends between the side rails 12. Because the first hingeplates 42 extend to the level of the top rung 18, they may be engaged by the stiffener plate 70 at this level. The stiffener plate 70 is raised into position between the first hingeplates 42 when the ladder frame is opened. Opening the ladder frame causes the locking elbow brackets 24 to rise upward into a locked horizontal position, between each side rail 12 and brace leg 20. These elbow brackets 24 are positioned such that they engage the underside of the stiffener plate 70. When the elbow rise to a locked position, they raise and hold the stiffener plate 70 to a horizontal position between the two first hingeplates 42. When the ladder is closed, the reverse is true. The elbow brackets 24 are bent downward allowing the stiffener plate 70 to fall by gravity into a stored position.

In another preferred embodiment, each nesting brace 30 has an expansible leg for stabilizing the ladder for use on all surfaces including even and uneven support surfaces. The expansible leg is needed with a step ladder embodiment of the invention because of the wider base stance of the ladder. The expansible leg takes into account the greater length needed to engage an even (or uneven) support surface. The expansible leg has a releasable carriage 32 which may be raise or lowered according to circumstances. The leg is secured at a selected height preferably by a simple mechanism such as a wingnut 34 and bolt 36. However, any means that allows for quick and secure adjustment of the expansible leg may be used.

In order to keep the lateral support braces in a nested position, a rubber male connector 90 on each brace 30 may be used in conjunction with a female connector 90*a* on each of the upright rails 12.

It is to be understood that the present invention is not limited to the embodiments described above, but encompasses any and all embodiments within the scope of the following claims.

I claim:

1. A ladder device comprising:

a pair of upright rails, each having an upper end and a lower end wherein said lower end is adapted for engaging a support surface;

a plurality of rungs extending between and connecting said pair of side rails, including a top rung which is a predetermined distance from said upper end of said side rails;

a pair of upright nesting braces sized and configured to nest over said side rails thereby merging said side rails and said nesting braces for storage and normal use of the ladder;

a pair of hinges, each of said hinges connecting one of said upper ends of said side rails to one of said upright nesting braces for selective rotation from a nested position to an outward position for lateral support of the ladder, each of said hinges further comprising a first hinge plate affixed to said side rail and a second hinge plate affixed to said upright nesting braces, wherein a vertical hinge joint connects the first and second hinge plates for rotation about said hinge joint;

a pair of support arms each for preventing over-rotation and movement of said upright nesting braces when in a support position, wherein each of said support arms has a first end slidably engaging and passing through said first hinge plate and has means for locking said support arm in an extended position corresponding to the support position of said upright nesting brace, wherein a second end of said support arm is pivotally attached to said second hinge plate, wherein said first and second hingeplates extend from the upper end of said side rails said predetermined distance to said top rung, and wherein said support arms slide within said top rung; and an upper and lower separator plate, wherein said support arms are separated within said top rung by the upper separator plate, and enclosed within said rung by the lower separator plate.

2. The ladder device as recited in claim 1 further comprising:

an expansible leg for stabilizing the ladder on even and uneven support surfaces, each expansible leg attached to an upright nesting brace, said expansible leg having a releasable carriage for adjustable engagement to said nesting brace; and means for securing said releasable carriage in a selected position such that said expansible leg engages a support surface.

3. The ladder device as recited in claim 1 wherein:

said each first hingeplate is integrally formed with said siderails; and said each second hingeplate is integrally formed with said nesting brace.

4. A ladder device comprising:

a top shelf;

a pair of upright rails, each having an upper end and a lower end wherein said upper end is affixed to said top shelf and said lower end is adapted for engaging a support surface;

a plurality of rungs extending between and connecting said pair of side rails, including a top rung which is a predetermined distance from said upper end of said side rails;

a pair of brace legs affixed for pivotal movement proximate said upper end of said side rails and said top shelf and having a brace tie connecting said brace legs to each other;

a pair of elbow brackets each having a forward end attached to one of said side rails and a rear end attached to one of said brace legs and having an elbow joint at a midpoint therebetween;

a pair of upright nesting braces sized and configured to nest over said side rails thereby merging said side rails and said nesting braces for storage and normal use of the ladder;

a pair of hinges, each of said hinges connecting one of said upper ends of said side rails to one of said upright nesting braces for selective rotation from a nested position to an outward position for lateral support of the ladder;

each hinge further comprising a first hinge plate affixed to said side rail and a second hinge plate affixed to said upright nesting brace wherein a vertical hinge joint connects the two hinge plates for rotation about said hinge joint wherein said hingeplates extend from the upper end of said side rails said predetermined distance to said top rung; and a stiffening plate hingedly attached to said rear edge of said top rung, said stiffening plate extending between said first hinge plates of each of said side rails such that when said brace legs are in an open position for use of said ladder said stiffener plate is in a horizontal position, supported by said elbow brackets, between said first hingeplates preventing their movement inward from stresses generated by the rotation and use of said nesting braces, and when said brace legs are in a closed position said stiffener plate rotates to a vertical position.

5. The ladder device as recited in claim 4 further comprising:

a pair of support arms each for preventing over-rotation and movement of said upright nesting braces when in a support position, wherein each of said support arms has a first end slidably engaging and passing through said first hinge plate and has means for locking said support arm in an extended position corresponding to the support position of said upright nesting brace, and wherein a second end of said support arm is pivotally attached to said second hinge plate.

6. The ladder device as recited in claim 5 wherein said support arms slide within said top rung.

7. The ladder device as recited in claim 5 further comprising an upper and lower separator plate, wherein said support arms are separated within said top rung by the upper separator plate, and enclosed within said rung by the lower separator plate.

8. The ladder device as recited in claim 4 further comprising:

an expansible leg for stabilizing the ladder on even and uneven support surfaces, each expansible leg attached to an upright nesting brace, said expansible leg having a releasable carriage for adjustable engagement to said nesting brace; and means for securing said releasable carriage in a selected position such that said expansible leg engages a support surface.

9. The ladder device as recited in claim 4 wherein:

said each first hingeplate is integrally formed with said siderails; and said each second hingeplate is integrally formed with said nesting brace.

10. A ladder device comprising:

a top shelf;

a pair of upright rails, each having an upper end and a lower end wherein said upper end is affixed to said top shelf and said lower end is adapted for engaging a support surface;

a plurality of rungs extending between and connecting said pair of side rails, including a top rung which is a predetermined distance from said upper end of said side rails;

a pair of brace legs affixed for pivotal movement proximate said upper end of said side rails and said top shelf and having a brace tie connecting said brace legs to each other;

a pair of elbow brackets each having a forward end attached to one of said side rails and a rear end attached to one of said brace legs and having an elbow joint at a midpoint therebetween;

a pair of upright nesting braces sized and configured to nest over said side rails thereby merging said side rails and said nesting braces for storage and normal use of the ladder;

a pair of hinges, each of said hinges connecting one of said upper ends of said side rails to one of said upright nesting braces for selective rotation from a nested position to an outward position for lateral support of the ladder;

each hinge further comprising a first hinge plate affixed to said side rail and a second hinge plate affixed to said upright nesting brace wherein a vertical hinge joint connects the two hinge plates for rotation about said hinge joint wherein said hingeplates extend from the upper end of said side rails said predetermined distance to said top rung;

a pair of support arms each for preventing over-rotation and accidental movement of said upright nesting braces when in the support position, wherein each of said support arms has a first end slidably engaging and passing through said first hinge plate and has means for locking said support arm in an extended position corresponding to the support position of said upright nesting brace, and wherein a second end of said support arm is pivotally attached to said second hinge plate; and a stiffening plate hingedly attached to said rear edge of said top rung, said stiffening plate extending between said first hinge plates of each of said side rails such that when said brace legs are in an open position for use of said ladder said stiffener plate is in a horizontal position, supported by said elbow brackets, between said first hingeplates preventing their movement inward from stresses generated by the rotation and use of said nesting braces, and when said brace legs are in a closed position said stiffener plate rotates to a vertical position.

11. The ladder device as recited in claim 10 wherein said support arms slide within said top rung.

12. The ladder device as recited in claim 11 further comprising an upper and lower separator plate, wherein said support arms are separated within said top rung by the upper separator plate, and enclosed within said rung by the lower separator plate.

13. The ladder device as recited in claim 12 further comprising:

an expansible leg for stabilizing the ladder on even and uneven support surfaces, each expansible leg attached to an upright nesting brace, said expansible leg having a releasable carriage for adjustable engagement to said nesting brace; and means for securing said releasable carriage in a selected position such that said expansible leg engages a support surface.

14. The ladder device as recited in claim 10 wherein:

said each first hingeplate is integrally formed with said siderails; and said each second hingeplate is integrally formed with said nesting brace.

* * * * *